US009580262B2

(12) United States Patent
Kurokawa

(10) Patent No.: US 9,580,262 B2
(45) Date of Patent: Feb. 28, 2017

(54) SHEET CONVEYING DEVICE

(71) Applicant: Brother Kogyo Kabushiki Kaisha, Nagoya-shi, Aichi-ken (JP)

(72) Inventor: Kotaro Kurokawa, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/499,453

(22) Filed: Sep. 29, 2014

(65) Prior Publication Data

US 2015/0091236 A1 Apr. 2, 2015

(30) Foreign Application Priority Data

Sep. 30, 2013 (JP) ..... 2013-203028

(51) Int. Cl.
*B65H 31/26* (2006.01)
*B65H 9/00* (2006.01)
(Continued)

(52) U.S. Cl.
CPC ..... *B65H 9/00* (2013.01); *B65H 29/14* (2013.01); *B65H 29/70* (2013.01); *B65H 31/02* (2013.01); *B65H 31/20* (2013.01); *B65H 31/26* (2013.01); *B65H 2301/4212* (2013.01); *B65H 2301/51214* (2013.01); *B65H 2404/1115* (2013.01); *B65H 2404/1317* (2013.01); *B65H 2404/63* (2013.01); *B65H 2405/111* (2013.01);
(Continued)

(58) Field of Classification Search
CPC ..... B65H 2301/42112; B65H 2301/42114; B65H 29/52; B65H 31/00; B65H 2301/4223; B65H 2301/5122; B65H 2405/1113; B65H 2405/11131; B65H 2405/1116; B65H 2405/11161; B65H 2405/1142
USPC ..... 271/171, 207, 209, 220, 221, 222, 223
See application file for complete search history.

(56) References Cited

U.S. PATENT DOCUMENTS 4,361,319 A * 11/1982 Ikeda et al. ..... 271/209
5,280,897 A * 1/1994 Maekawa ..... 271/3.03
(Continued)

FOREIGN PATENT DOCUMENTS

JP 64-64969 * 3/1989
JP H05-097313 A 4/1993
(Continued)

OTHER PUBLICATIONS

Apr. 26, 2016—(CN) The First Office Action—App 201410514182.4.
Dec. 19, 2016—(CN) The Second Office Action—App 201410514182.4.

*Primary Examiner* — Thomas Morrison
(74) *Attorney, Agent, or Firm* — Banner & Witcoff, Ltd.

(57) ABSTRACT

A sheet conveying device including a conveying section configured to convey a sheet in a predetermined conveying direction, a discharge section configured to discharge the sheet onto a stacking surface and configured to support the sheet, which is discharged by the discharge section, from below, a first contact portion provided on the stacking surface at a middle portion of the stacking surface in a width direction orthogonal to the conveying direction; a second contact portion provided on the stacking surface at one side with respect to the first contact portion in the width direction; and a third contact portion provided on the stacking
(Continued)

surface at an other side with respect to the first contact portion in the width direction.

17 Claims, 8 Drawing Sheets

(51) Int. Cl.

| | |
|---|---|
| ***B65H 29/14*** | (2006.01) |
| ***B65H 29/70*** | (2006.01) |
| ***B65H 31/02*** | (2006.01) |
| ***B65H 31/20*** | (2006.01) |

(52) U.S. Cl.
CPC ..... *B65H 2405/115* (2013.01); *B65H 2405/11151* (2013.01); *B65H 2405/3321* (2013.01); *B65H 2511/12* (2013.01); *B65H 2511/20* (2013.01); *B65H 2515/81* (2013.01); *B65H 2801/39* (2013.01)

(56) References Cited

U.S. PATENT DOCUMENTS

| | | | | |
|---|---|---|---|---|
| 8,016,287 | B2 * | 9/2011 | Watanabe | 271/209 |
| 8,348,415 | B2 * | 1/2013 | Nagata | 347/104 |
| 2006/0017219 | A1 * | 1/2006 | Yamada | 271/209 |
| 2010/0096794 | A1 | 4/2010 | Watanabe | |
| 2012/0070212 | A1 | 3/2012 | Ishida | |
| 2012/0242035 | A1 * | 9/2012 | Yoshida | 271/220 |
| 2012/0274021 | A1 * | 11/2012 | Nakamura et al. | 271/314 |
| 2014/0151957 | A1 * | 6/2014 | Ono | 271/207 |
| 2014/0300048 | A1 * | 10/2014 | Nakamura | 271/209 |

FOREIGN PATENT DOCUMENTS

| | | | |
|---|---|---|---|
| JP | H06-023955 U | | 3/1994 |
| JP | 2010-109813 | * | 5/2010 |
| JP | 2012-062185 A | | 3/2012 |

* cited by examiner

SHEET CONVEYING DEVICE

CROSS-REFERENCE TO RELATED APPLICATIONS

This application claims priority from Japanese Patent Application No. 2013-203028 filed on Sep. 30, 2013, the entire contents of which are incorporated herein by reference.

TECHNICAL FIELD

The following disclosure relates to a sheet conveying device.

BACKGROUND

JP-U-H06-23955 discloses an example of a sheet conveying device in a related art. The sheet conveying device includes a conveying section and a discharge section. The conveying section conveys a sheet in a predetermined conveying direction. The discharge section forms a part of the conveying section. The discharge section discharges the sheet onto a stacking surface positioned on a downstream side of the discharge section in the conveying direction. The stacking surface extends in the conveying direction and a width direction orthogonal to the conveying direction. The stacking surface is configured to support the sheet, which is discharged by the discharge section, from below.

A first contact portion is provided on the stacking surface at a middle portion of the stacking surface in the width direction. An upper end of the first contact portion is positioned above the stacking surface and extends in the conveying direction. The upper end of the first contact portion is configured to come into contact with the sheet, which is discharged by the discharge section, from below.

In the sheet conveying device, when a sheet is discharged onto the stacking surface, a middle portion of the sheet in the width direction is raised by the upper end of the first contact portion that extends in the conveying direction. Accordingly, since the sheet is curved in an inverted U-shape in the cross-section thereof perpendicular to the conveying direction, the downward bending of the middle portion of the sheet in the width direction, which is caused by gravity, may be suppressed. That is, it is possible to make the sheet, which is placed on the stacking surface, to have stiffness by the first contact portion. In the sheet conveying device, a plurality of sheets are stably discharged and stacked onto the stacking surface in this way.

SUMMARY

Incidentally, in recent sheet conveying devices, there is a sheet conveying device that can convey a sheet having a small size, such as the size of a postcard, or a sheet which is thick and not easily bendable, by a conveying section, and can discharge the sheet onto a stacking surface by a discharge section. In this regard, when such a sheet is discharged onto the stacking surface in the sheet conveying device in the related art, although the middle portion of the sheet in the width direction is raised by the upper end of the first contact portion, the sheet is not curved in an inverted U-shape in the cross-section thereof perpendicular to the conveying direction, but is likely to be inclined about the upper end of the first contact portion as a center. Accordingly, one edge of the sheet in the width direction comes into contact with the stacking surface and the other edge thereof in the width direction is separated upward from the stacking surface. For this reason, the sheet, which is discharged onto the stacking surface later, easily interferes with a previous sheet. As a result, in the sheet conveying device, there is a concern that the discharge of a later sheet is hindered or a plurality of sheets are stacked on the stacking surface without being aligned.

Aspects of the disclosure relate to a sheet conveying device that may stably discharge and stack a plurality of sheets onto a stacking surface regardless of the kinds of sheets.

In one aspect of the disclosure, there is provided a sheet conveying device including: a conveying section configured to convey a sheet in a predetermined conveying direction; a discharge section configured to discharge the sheet onto a stacking surface and configured to support the sheet, which is discharged by the discharge section, from below; a first contact portion provided on the stacking surface at a middle portion of the stacking surface in a width direction orthogonal to the conveying direction; a second contact portion provided on the stacking surface at one side with respect to the first contact portion in the width direction; and a third contact portion provided on the stacking surface at an other side with respect to the first contact portion in the width direction.

In the sheet conveying device according to the aspect of the invention, when a sheet, which is thin and easily bendable, is discharged onto the stacking surface, the middle portion of the sheet in the width direction is raised by the upper end of the first contact portion. Accordingly, it is possible to make the sheet have stiffness by curving the sheet in an inverted U-shape in the cross-section thereof perpendicular to the conveying direction. As a result, in the sheet conveying device, a plurality of sheets, which are thin and easily bendable, can be stably discharged and stacked onto the stacking surface.

BRIEF DESCRIPTION OF DRAWINGS

For a more complete understanding of the present disclosure, needs satisfied thereby, and the objects, features, and advantages thereof, reference now is made to the following illustrative descriptions taken in connection with the accompanying drawings.

FIG. 3 relates to the image reading apparatus of the first illustrative embodiment and is a partial perspective view showing a stacking surface, a first contact portion, and the like;

FIG. 5 relates to the image reading apparatus of the first illustrative embodiment and is a partial perspective view showing a discharge section, the stacking surface, the first contact portion, a second contact portion, a third contact portion, and the like;

FIG. 6A is a partial cross-sectional view illustrating action of the first contact portion, the second contact portion, and the third contact portion on a sheet, which is thin and easily bendable, in a cross-section taken along line B-B of FIG. 4, and FIG. 6B is a partial cross-sectional view illustrating the action of the first contact portion, the second contact portion, and the third contact portion on a sheet, which has a small size or is thick and not easily bendable, in the cross-section taken along line B-B of FIG. 4;

FIG. 7 relates to an image reading apparatus of a second illustrative embodiment and is a partial perspective view showing a discharge section, a stacking surface, a first contact portion, a second contact portion, a third contact portion, and the like;

FIG. 8 relates to an image reading apparatus of a third illustrative embodiment and is a partial perspective view showing a discharge section, a stacking surface, a first contact portion, a second contact portion, a third contact portion, and the like; and FIG. 9 relates to an image reading apparatus of a fourth illustrative embodiment and is a partial top view showing a discharge section, a stacking surface, a first contact portion, a second contact portion, a third contact portion, and the like.

DETAILED DESCRIPTION

First to fourth illustrative embodiments will be described hereinafter with reference to the drawings.

First Illustrative Embodiment

Figure 1:
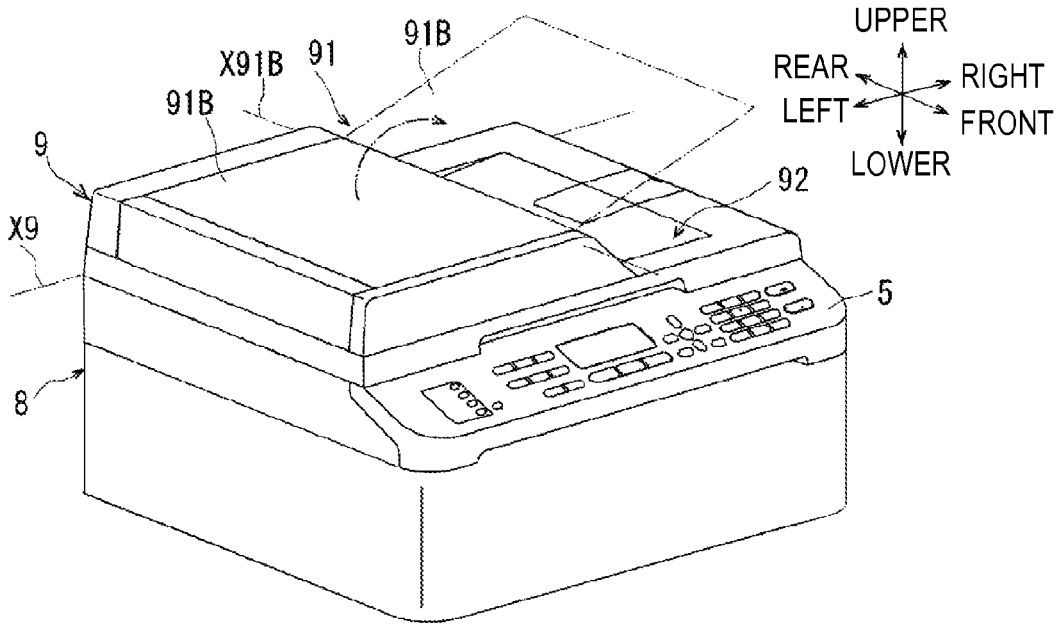
FIG. 1 is a perspective view of an image reading apparatus of a first illustrative embodiment.

As shown in FIG. 1, an image reading apparatus 1 of the embodiment is an example of a specific aspect of a sheet conveying device. In FIG. 1, the respective directions, that is, the front direction, the rear direction, the left direction, the right direction, the upper direction, and the lower direction are shown by defining a side on which an operation panel 5 is provided as a front side of the apparatus and a side corresponding to a left hand of a user when the user faces the operation panel 5 as a left side. Further, all of the respective directions shown in FIGS. 2 to 9 are shown so as to correspond to the respective directions shown in FIG. 1. The respective components of the image reading apparatus 1 will be described below with reference to FIG. 1 and the like.

<Entire Structure>

As shown in FIGS. 1 to 4, the image reading apparatus 1 includes a main body 8 and an opening/closing section 9. The main body 8 is a substantially flat box-shaped body. As shown in FIG. 1, the operation panel 5 is provided on the front side of the main body 8.

Figure 4:
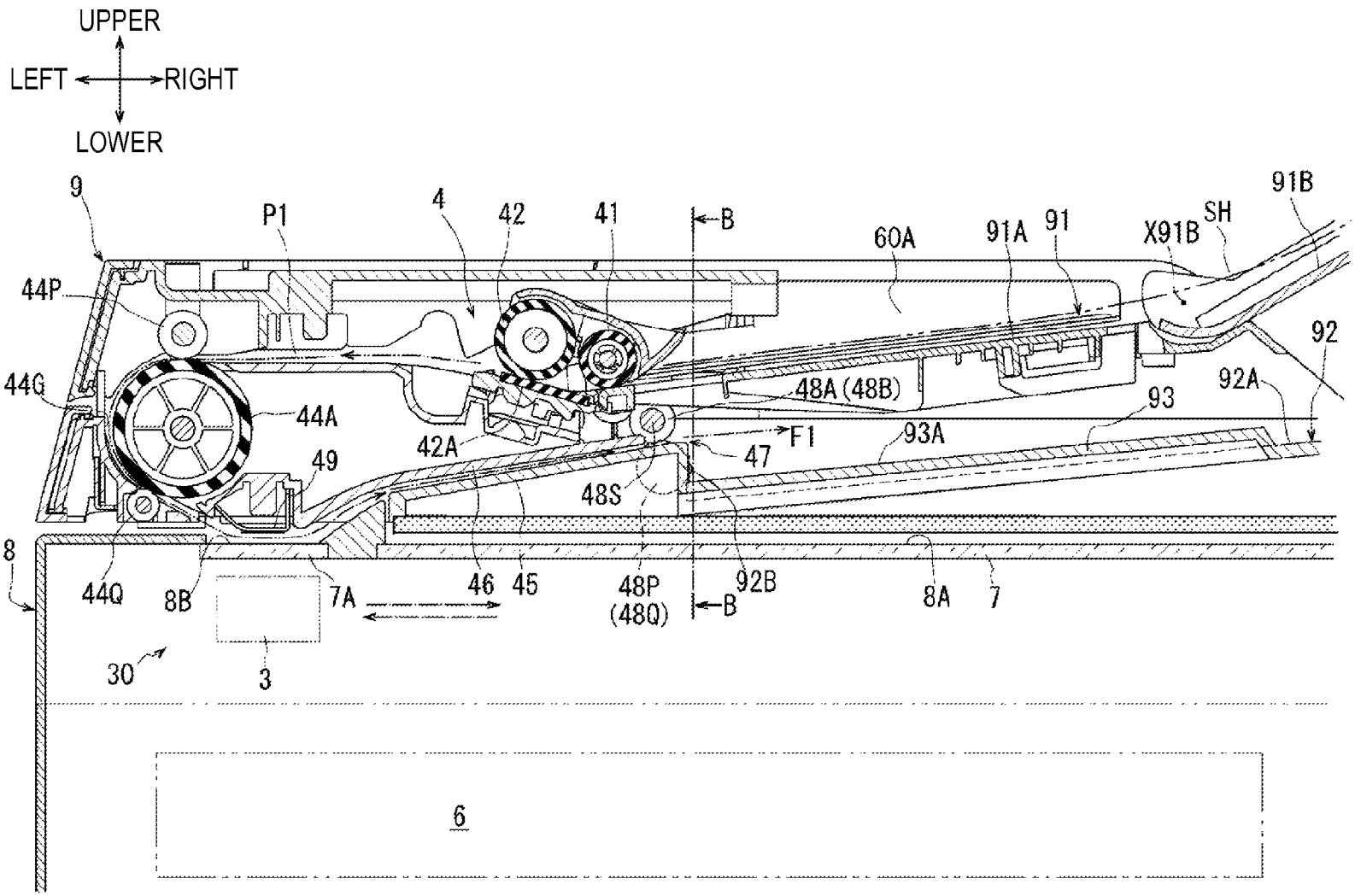
FIG. 4 relates to the image reading apparatus of the first illustrative embodiment and is a partial cross-sectional view showing a cross-section taken along line A-A of FIG. 2.

As shown in FIG. 4, an image forming unit 6 is provided at a lower portion in the main body 8. Although not shown, ink-jet type image forming sections, laser type image forming sections, or the like are accommodated in the image forming unit 6.

A reading unit 30 is provided at an upper portion in the main body 8. A first platen glass 7 and a second platen glass 7A are provided on the upper surface of the reading unit 30. An upper surface of the first platen glass 7 serves as a support surface 8A. When an image of a document is read in a stationary state, the support surface 8A supports the document from below. The document includes a book or the like in addition to paper and an OHP sheet. The second platen glass 7A is positioned on the left side of the first platen glass 7, and extends so as to be elongated in a front and rear direction.

As shown in FIG. 1, the opening/closing section 9 is supported by a hinge (not shown), which is disposed at an upper edge of the rear surface of the main body 8, so as to be capable of swinging about an opening/closing axis X9 extending in a left and right direction. As shown by the solid line in FIG. 1, the opening/closing section 9 covers the support surface 8A from above in a closed state. Although not shown, the opening/closing section 9 swings about the opening/closing axis X9 so that a front end portion of the opening/closing section 9 is displaced upward and rearward. As a result, the opening/closing section 9 opens the upper side of the support surface 8A. Accordingly, a user can place a document to be read on the support surface 8A.

Further, as shown in FIGS. 1 and 4, the image reading apparatus 1 includes a reading section 3, a feed tray 91, a discharge tray 92, a conveying section 4, and a discharge section 47.

As shown in FIG. 4, the reading section 3 is accommodated in the reading unit 30 of the main body 8. A well-known image reading sensor, such as a contact image sensor (CIS) or a charge coupled device (CCD), is used as the reading section 3. A sensor of the reading section 3 extends in the front and rear direction, which corresponds to the main-scanning direction.

The reading section 3 can be reciprocated in the left and right direction, which corresponds to the sub-scanning direction, below the first platen glass 7 by a scanning mechanism (not shown). When the image of the document, which is supported on the support surface 8A, is read, the scanning mechanism (not shown) operates and moves the reading section 3 toward a right end from a left end in the reading unit 30. Further, when images are read while a plurality of sheets SH stacked on the feed tray 91 are conveyed, the scanning mechanism (not shown) operates and moves the reading section 3 toward a left end in the reading unit 30 shown in FIG. 4, and stops the reading section 3 at a predetermined reading position facing the second platen glass 7A from below. The surface of the second platen glass 7A, which faces upwardly, serves as a reading surface 8B.

Figure 2:
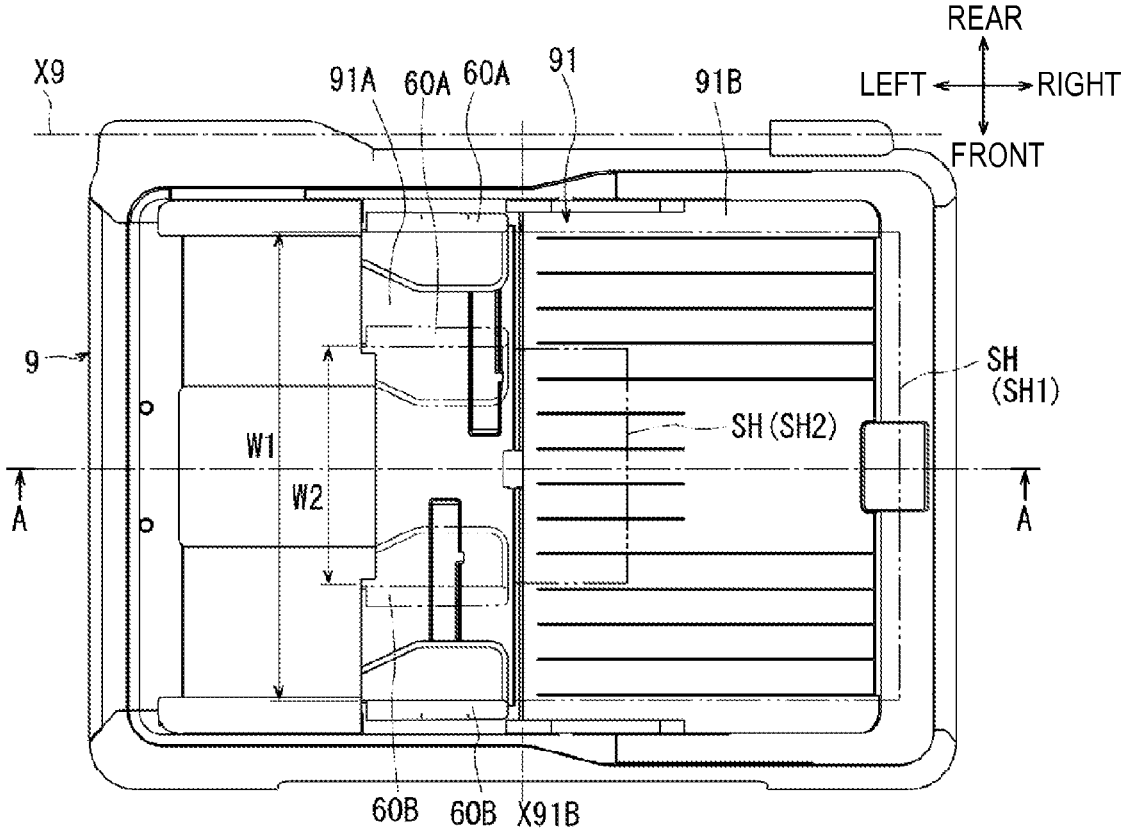
FIG. 2 is a top view of the image reading apparatus of the first illustrative embodiment.
Figure 3:
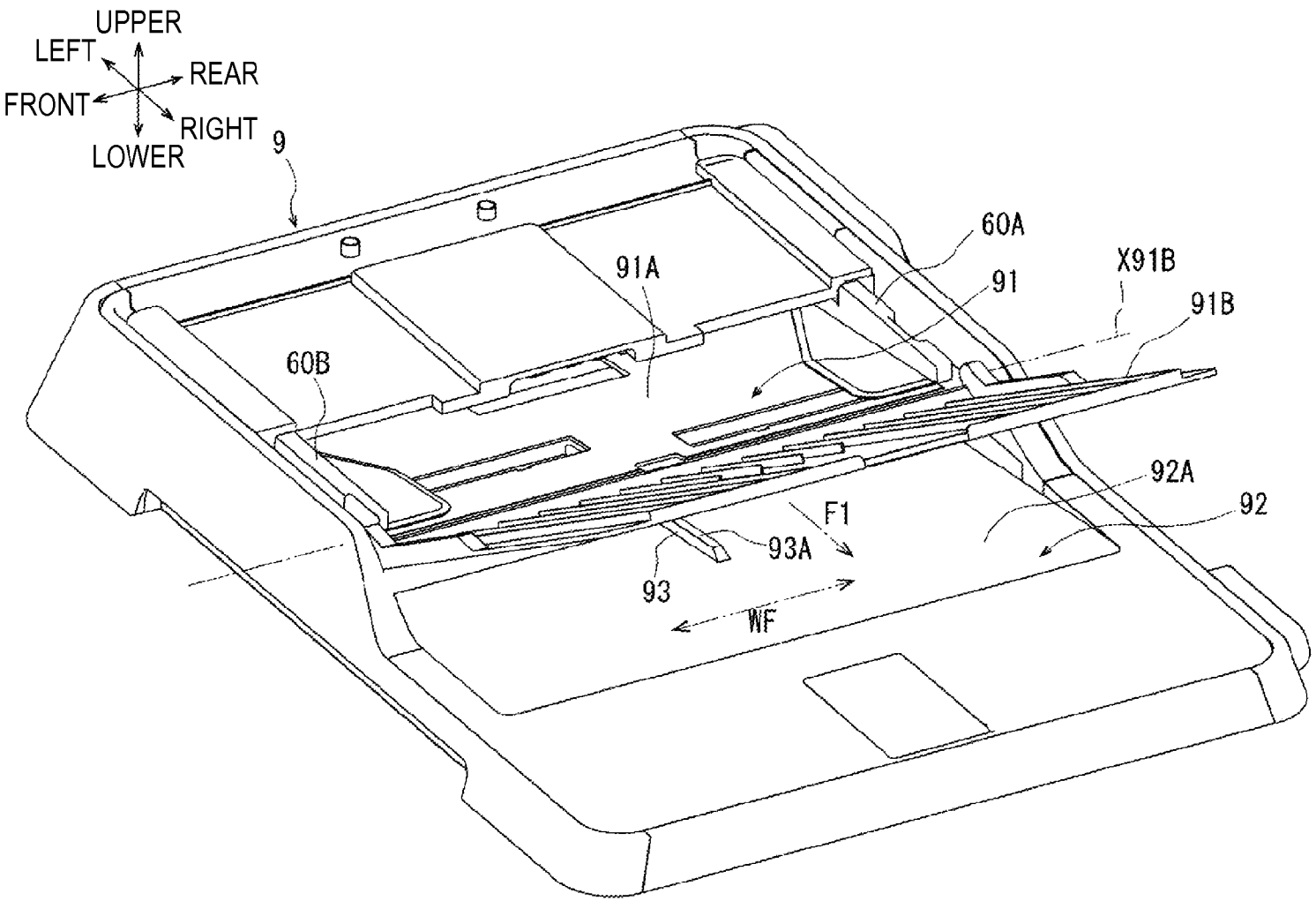

As shown in FIGS. 2, 3, and 4, the feed tray 91 is provided in the opening/closing section 9. The feed tray 91 includes a stationary tray part 91A and a movable tray part 91B. The stationary tray part 91A is disposed at an upper portion of the middle portion of the opening/closing section 9, and extends in the front and rear direction and the left and right direction so as to have the shape of a substantially flat plate. The movable tray part 91B is supported by the opening/closing section 9 so as to be capable of swinging about an opening/closing axis X91B that extends in the front and rear direction at a right edge of the stationary tray part 91A. As shown in FIGS. 2 to 4, the movable tray part 91B continues to the stationary tray part 91A so as to form an inclined surface, which is inclined upwardly toward the right side, by swinging to the right side as shown by the two-dot chain line in FIG. 1 from a closed state that is shown by the solid line in FIG. 1. When a plurality of sheets are read while being conveyed, the feed tray 91, which is in an open state, supports a sheet SH to be read from below.

A pair of guides 60A and 60B are provided on the stationary tray part 91A of the feed tray 91 so as to be capable of sliding in the front and rear direction. The pair of guides 60A and 60B face each other in the front and rear direction. The pair of guides 60A and 60B are connected to each other by a rack-pinion mechanism (not shown). The pair of guides 60A and 60B come close to each other or are separated from each other, so that plural kinds of sheets SH of different sizes supported by the feed tray 91 are sandwiched between the pair of guides 60A and 60B in the front and rear direction. The pair of guides 60A and 60B position a sheet SH, which is placed on the feed tray 91, at the center of the feed tray 91 in the front and rear direction.

For example, when a large-sized sheet SH1 (hereinafter, referred to as a first sheet SH1), which is A4-size paper or the like, is positioned on the feed tray 91 as shown in FIG.

2, the pair of guides 60A and 60B are separated from each other in the front and rear direction by a distance, which is equal to a length W1 of the first sheet SH1 in the front and rear direction, as shown by the solid line in FIG. 2. Further, when a small-sized sheet SH2 (hereinafter, referred to as a second sheet SH2), such as a postcard, is positioned on the feed tray 91, the pair of guides 60A and 60B are separated from each other in the front and rear direction by a distance that is equal to a length W2 of the second sheet SH2 in the front and rear direction as shown by the two-dot chain line in FIG. 2. In this embodiment, the second sheet SH2 is a sheet SH having the smallest size that can be conveyed by the conveying section 4. In the following description, the sheets SH1 and SH2 will be described as "sheets SH" without being distinguished from each other when description common to the sheets SH1 and SH2 is made.

The discharge tray 92 is provided below the feed tray 91 at a right portion of the opening/closing section 9. An upper surface of the discharge tray 92 serves as a stacking surface 92A to be described later. A sheet SH, which is conveyed by the conveying section 4, is discharged onto the stacking surface 92A of the discharge tray 92 by the discharge section 47.

As shown in FIG. 4, the conveying section 4 defines a conveying passage P1 as a space that is surrounded by guide surfaces extending so as to be capable of coming into contact with one surface and the other surface of the sheet SH. First, the conveying passage P1 includes a portion that substantially horizontally extends toward the left side from the feed tray 91. Then, the conveying passage P1 includes a portion that makes a U-turn downward portion. Next, the conveying passage P1 includes a portion that extends along the reading surface 8B to the right side by a short length. Finally, the conveying passage P1 includes a portion that is inclined upwardly toward the right side and reaches the discharge tray 92.

Figure 5:
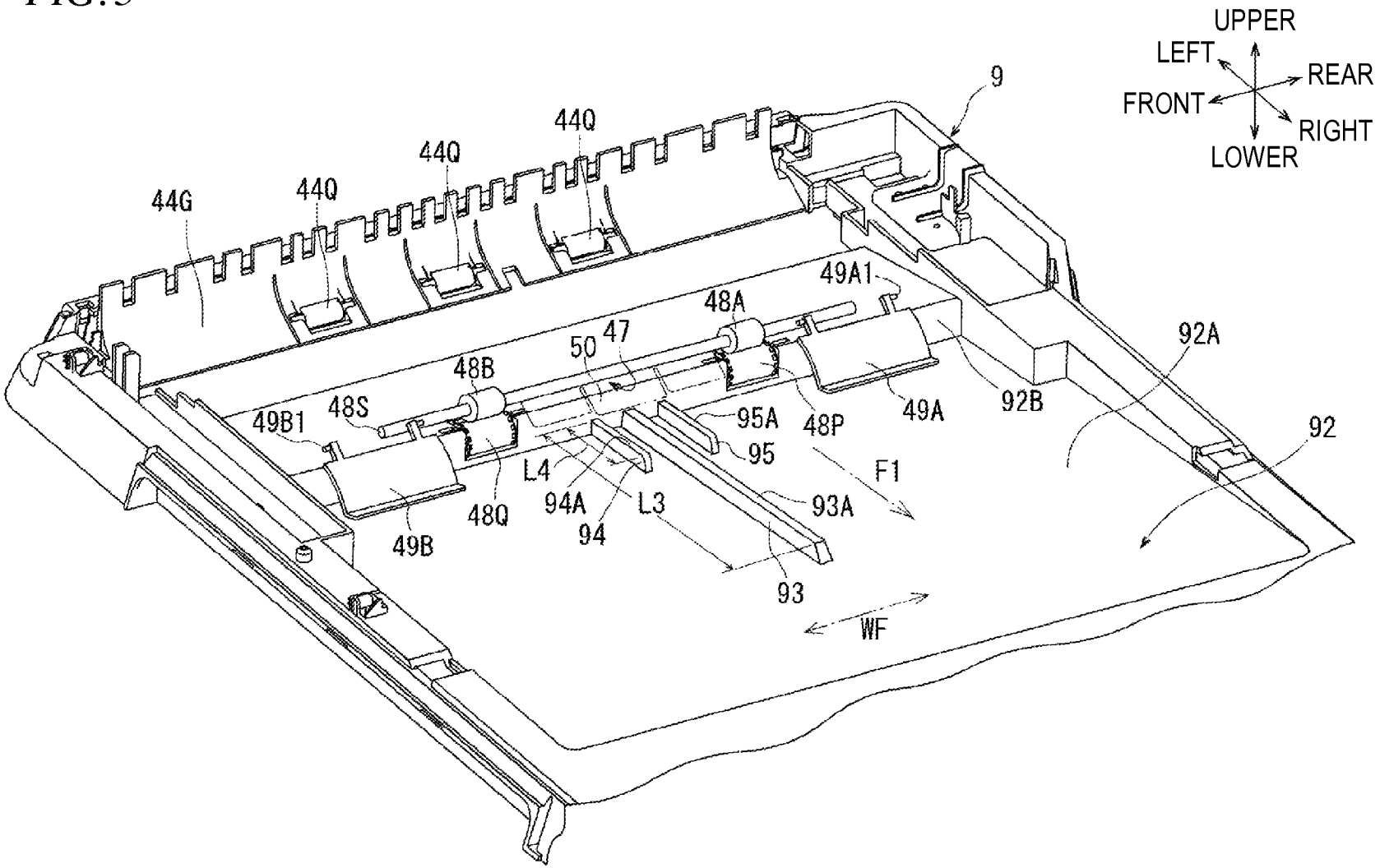

The conveying direction of the sheet SH, which is conveyed by the conveying section 4, is directed to the left on the substantially horizontal portion that is an upper portion of the conveying passage P1, is changed to the right from the left on the portion of the conveying passage P1 that makes a U-turn downward portion, and is then directed to the right on the portion that is a lower portion of the conveying passage P1 and reaches the discharge tray 92 via the reading surface 8B. In FIGS. 3 to 5, the conveying direction of the portion of the conveying passage P1, which reaches the discharge tray 92, is denoted by F1. Further, in FIGS. 3, 5, and 6, a width direction orthogonal to the conveying direction is denoted by WF. The width direction WF is the front and rear direction. In other words, the length W2 of the second sheet SH2 in the front and rear direction is a distance between both edges of the second sheet SH2 in the width direction WF.

As shown in FIG. 4, the conveying section 4 includes a feed roller 41, a separation roller 42, and a separation pad 42A that are provided at a position close to the feed tray 91 on the conveying passage P1. The feed roller 41 sends a sheet SH, which is placed on the feed tray 91, to the separation roller 42 that is provided on the downstream side in the conveying direction. When a plurality of sheets SH are likely to be conveyed while overlapping each other, the separation roller 42 separates the sheets SH one by one in cooperation with the separation pad 42A and conveys each sheet SH to the further downstream side in the conveying direction.

The conveying section 4 includes a conveying roller 44A and a curved guide surface 44G that are provided on the portion of the conveying passage P1 making a U-turn downward portion. The conveying roller 44A forms an inner guide surface of the portion of the conveying passage P1 that makes a U-turn downward portion. The curved guide surface 44G forms an outer guide surface of the portion of the conveying passage P1 that makes a U-turn downward portion. The conveying roller 44A conveys the sheet SH to the reading surface 8B in cooperation with pinch rollers 44P and 44Q that come into contact with the outer periphery of the conveying roller 44A.

The conveying section 4 includes a pressing member 49 that is provided at a position facing the reading surface 8B from above. The pressing member 49 presses the sheet SH from above by a biasing member (not shown) and makes the sheet SH come into contact with the reading surface 8B.

The conveying section 4 includes two guide walls 45 and 46 that are provided at an upwardly inclined portion of the conveying passage P1 formed on the right side of the pressing member 49. The guide wall 45 forms the upwardly inclined portion of the conveying passage P1 from below. The guide wall 46 is positioned above the guide wall 45 and forms a gap between the guide wall 45 and itself. The guide wall 46 forms the upwardly inclined portion of the conveying passage P1 from above.

The conveying section 4 includes discharge rollers 48A and 48B and pinch rollers 48P and 48Q that are provided at right end portions of the guide walls 45 and 46 facing the discharge tray 92. The discharge section 47 includes the guide walls 45 and 46, the discharge rollers 48A and 48B, and the pinch rollers 48P and 48Q. That is, the discharge section 47 forms a part of the conveying section 4. The reading section 3, which is stopped at the predetermined reading position, is positioned on the upstream side of the discharge section 47 in the conveying direction.

As shown in FIGS. 3 to 6, the discharge rollers 48A and 48B are rotationally driven by a drive shaft 48S that extends parallel to the width direction WF. The discharge rollers 48A and 48B discharge the sheet SH, which has passed above the reading surface 8A, onto the stacking surface 92A of the discharge tray 92 in cooperation with the pinch rollers 48P and 48Q. The conveying direction F1 means a discharge direction in which a sheet SH is discharged onto the stacking surface 91A of the discharge tray 92 by the discharge section 47.

<Image Reading Operation>

When the image of the document, which is supported by the support surface 8A, is read in the image reading apparatus 1, the scanning mechanism (not shown) operates and moves the reading section 3 toward the right end from the left end in the reading unit 30 as shown in FIG. 4. Accordingly, the reading section 3 reads the image of the document that is supported by the support surface 8A. After that, the scanning mechanism (not shown) moves the reading section 3, which has completely read the image, toward the left end from the right end in the reading unit 30 and returns the reading section 3 to an original position.

Further, when images are read in the image reading apparatus 1 while a plurality of sheets SH stacked on the feed tray 91 are conveyed, the scanning mechanism (not shown) operates and stops the reading section 3 at the predetermined reading position facing the second platen glass 7A as shown in FIG. 4. Furthermore, when the conveying section 4 sequentially conveys the sheets SH, which are stacked on the feed tray 91, along the conveying passage P1, the sheets SH pass above the reading section 3 present at the predetermined reading position while coming into contact with the reading surface 8B. Accordingly, the reading section 3 reads the images of the sheets SH that are passing. The sheets SH of which the images have been read are discharged onto the stacking surface 92A of the discharge tray 92 by the discharge section 47.

<Specific Structure of Stacking Surface and the Like>

As shown in FIGS. 3 to 6, the stacking surface 92A of the discharge tray 92 extends in the conveying direction F1, which is a direction in which the discharge section 47 discharges the sheet SH, and the width direction WF. The stacking surface 92A is inclined upwardly toward the right side by a small angle. The left edge of the stacking surface 92A is connected to the lower edge of a standing wall 92B that substantially vertically hangs down from the right edge of the guide wall 45. The stacking surface 92A includes a first contact portion 93, a second contact portion 94, and a third contact portion 95.

The first contact portion 93 is provided on a middle portion of the stacking surface 92A in the width direction WF. The first contact portion 93 is a rib that is integrally formed so as to rise upward from the stacking surface 92A. The first contact portion 93 extends from the standing wall 92B in the conveying direction F1, that is, to the right side. An upper end 93A of the first contact portion 93 is positioned above the stacking surface 92A. The upper end 93A is a flat surface that extends from the standing wall 92B to the right side. The upper end 93A of the first contact portion 93 is configured to come into contact with the sheet SH, which is discharged onto the stacking surface 92A by the discharge section 47, from below.

The second contact portion 94 is provided on the stacking surface 92A at one side with respect to the first contact portion 93 in the width direction WF, that is, at the front side of the first contact portion 93. The second contact portion 94 is a rib that is integrally formed so as to rise upward from the stacking surface 92A. The second contact portion 94 extends from the standing wall 92B in the conveying direction F1, that is, to the right side. The second contact portion 94 extends parallel to the first contact portion 93. An upper end 94A of the second contact portion 94 is positioned above the stacking surface 92A. The upper end 94A is a flat surface that extends from the standing wall 92B to the right side. The upper end 94A of the second contact portion 94 is configured to come into contact with the sheet SH, which is discharged onto the stacking surface 92A by the discharge section 47, from below.

The third contact portion 95 is provided on the stacking surface 92A at an other side with respect to the first contact portion 93 in the width direction WF, that is, at the rear side of the first contact portion 93. The third contact portion 95 is a rib that is integrally formed so as to rise upward from the stacking surface 92A. The third contact portion 95 extends from the standing wall 92B in the conveying direction F1, that is, to the right side. The third contact portion 95 extends parallel to the first contact portion 93. An upper end 95A of the third contact portion 95 is positioned above the stacking surface 92A. The upper end 95A is a flat surface that extends from the standing wall 92B to the right side. The upper end 95A of the third contact portion 95 is configured to come into contact with the sheet SH, which is discharged onto the stacking surface 92A by the discharge section 47, from below.

Figure 6A:
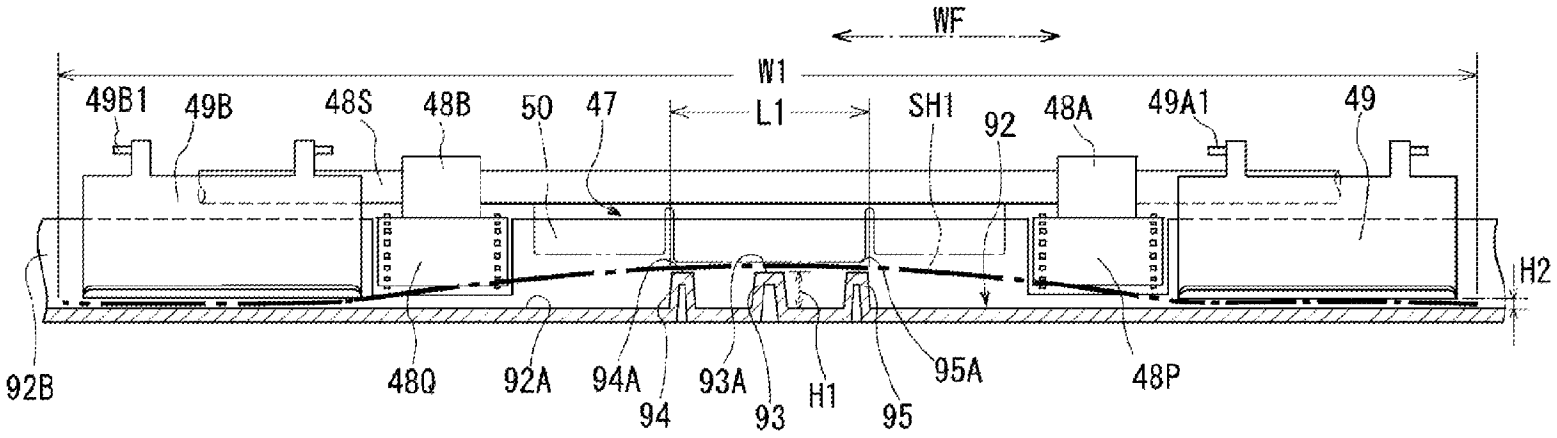
FIGS. 6A and 6B relate to the image reading apparatus of the first illustrative embodiment.

As shown in FIG. 6A, the upper end 93A of the first contact portion 93, the upper end 94A of the second contact portion 94, and the upper end 95A of the third contact portion 95 has the same height H1 from the stacking surface 92A. The respective upper ends 93A, 94A, and 95A, which are flat surfaces, are included in one plane parallel to the stacking surface 92A.

Figure 6B:
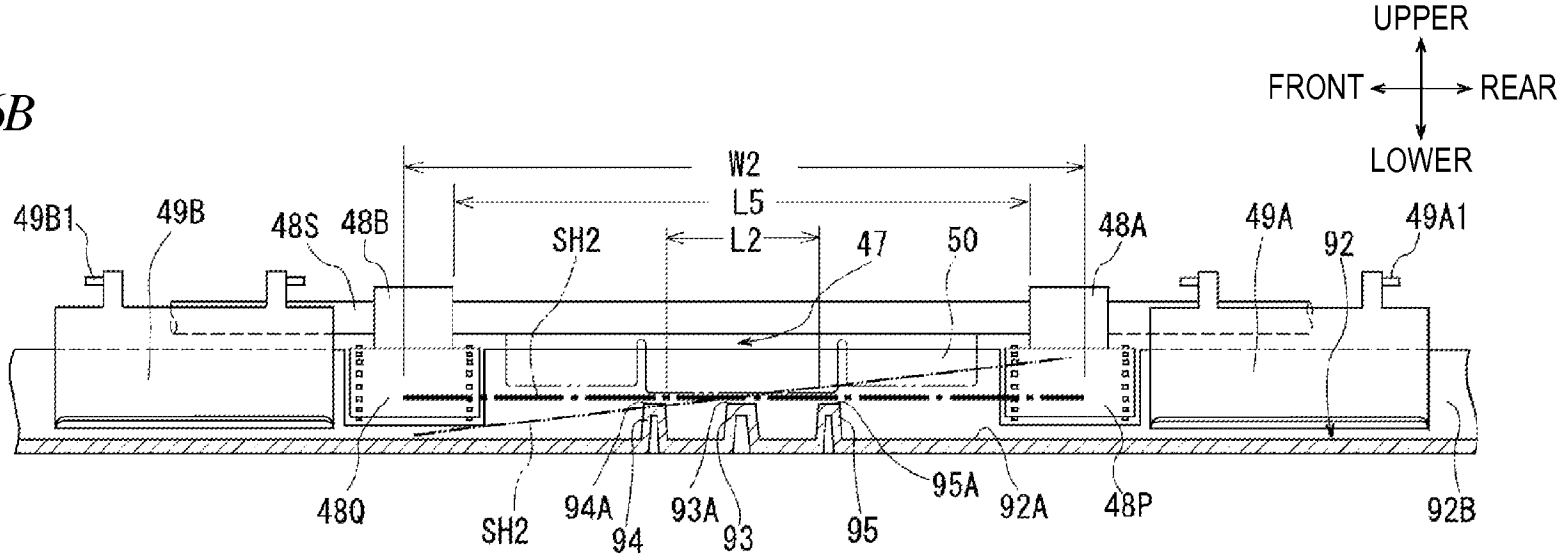

As shown in FIG. 6B, a distance L5 between a set of the discharge roller 48A and the pinch roller 48P positioned on the rear side and a set of the discharge roller 48B and the pinch roller 48Q positioned on the front side is smaller than the length W2 of the second sheet SH2 in the width direction WF. That is, the distance L5 is a distance that allows both edges of the second sheet SH2, which has the smallest size and can be conveyed by the conveying section 4, or a sheet SH, which is larger than the second sheet SH2, in the width direction WF to be pinched by the discharge rollers 48A and 48B and the pinch rollers 48P and 48Q and allows the sheet to be capable of being conveyed.

A distance between the upper end 94A of the second contact portion 94 and the upper end 95A of the third contact portion 95 in the width direction WF is L2. The distance L2 is equal to or smaller than the length W2 of the second sheet SH2, which has the smallest size, in the width direction WF. In this embodiment, the distance L2 is smaller than half of the length W2 of the second sheet SH2, which has the smallest size, in the width direction WF.

As shown in FIG. 6A, a distance between a front edge, which extends in the left and right direction, of the upper end 94A of the second contact portion 94 and a rear edge, which extends in the left and right direction, of the upper end 95A of the third contact portion 95 in the width direction WF is distance L1. In this embodiment, the distance L1 is also smaller than half of the length W2 of the second sheet SH2, which has the smallest size, in the width direction WF.

As shown in FIG. 5, the length of the upper end 93A of the first contact portion 93 in the conveying direction F1 is L3. The length L3 is appropriately set according to the size, the thickness, or the like of the first sheet SH1. In this embodiment, the length L3 is in the range of about ⅓ to ½ of the length of the first sheet SH1 in the conveying direction F1. However, the length L3 may be set to increase up to about the length of the first sheet SH1 in the conveying direction F1.

The length of the upper end 94A of the second contact portion 94 in the conveying direction F1 and the length of the upper end 95A of the third contact portion 95 in the conveying direction F1 are L4. The length L4 is smaller than the length L3 of the first contact portion 93 in the conveying direction F1. The length L4 is appropriately set according to the size, the thickness, or the like of the second sheet SH2. In this embodiment, the length L4 is in the range of about ⅓ to ½ of the length of the second sheet SH2 in the conveying direction F1. Further, in this embodiment, the length L4 is in the range of about ⅓ to ½ of the length L3 of the upper end 93A of the first contact portion 93 in the conveying direction F1. The above-mentioned setting of the length L4 is to make an action of the upper end 93A of the first contact portion 93 on the first sheet SH1, which will be described later, to be effective.

As shown in FIGS. 5 and 6, a pair of pushing members 49A and 49B are provided at an outside space of the set of the discharge roller 48A and the pinch roller 48P and the set of the discharge roller 48B and the pinch roller 48Q in the width direction WF. Each of the pushing members 49A and 49B extends toward the stacking surface 92A of the discharge tray 92 from above. The pushing member 49B is positioned on the front side of the second contact portion 94. The pushing member 49A is positioned on the rear side of the third contact portion 95.

The pushing members 49A and 49B are swingably supported below the stationary tray part 91A by shafts 49A1 and 49B1 that extend in the width direction WF at the upper ends of the pushing members 49A and 49B. Each of the pushing members 49A and 49B is biased in a direction where a lower end of each of the pushing members 49A and 49B comes close to the stacking surface 92A by a biasing member (not shown).

As shown in FIG. 6A, a distance between the lower end of each of the pushing members 49A and 49B and the stacking surface 92A is denoted by H2 at a position where each of the pushing members 49A and 49B has swung to the lowest portion. The distance H2 is smaller than a distance H1 between each of the upper ends 93A, 94A, and 95A of the first contact portion 93, the second contact portion 94, and the third contact portion 95 and the stacking surface 92A.

As shown in FIGS. 5 and 6, the discharge tray 92 includes a guide piece 50. The guide piece 50 is positioned above the stacking surface 92A in the middle of the discharge section 47 in the width direction WF. The guide piece 50 is formed of a resin film-like material having elasticity. An upper end portion of the guide piece 50 is attached to the guide wall 46 shown in FIG. 4. As shown in FIGS. 5 and 6, a lower end portion of the guide piece 50 is inclined downward toward the first contact portion 93, the second contact portion 94, and the third contact portion 95.

<Effects>

In the image reading apparatus 1 of the first illustrative embodiment, when a sheet SH is discharged onto the stacking surface 92A by the discharge section 47, the guide piece 50 is pushed and elastically deformed first by the sheet SH to be discharged and the sheet SH is biased toward the stacking surface 92A, the first contact portion 93, the second contact portion 94, and the third contact portion 95, which are positioned below the guide piece 50, by a restoring force of the guide piece 50. Further, when the lower end portions of the pushing members 49A and 49B come into contact with both edge portions, in the width direction WF, of the sheet SH which is to be discharged, the pushing members 49A and 49B are biased by the biasing member (not shown) to bias both the edge portions of the sheet SH1 in the width direction WF toward the stacking surface 92A.

As shown in FIG. 6A, when the sheet SH, which is discharged onto the stacking surface 92A by the discharge section 47, is the first sheet SH1 that is thin and easily bendable and the first sheet SH1 starts to be discharged from the discharge section 47 in the conveying direction F1, the tip of the first sheet SH1 hangs down due to gravity and the first sheet SH1 slides and moves in the conveying direction F1 while coming into contact with the respective upper ends 93A, 94A, and 95A of the first contact portion 93, the second contact portion 94, and the third contact portion 95. Then, the first sheet SH1 further slides and moves in the conveying direction F1 while coming into contact with only the upper end 93A of the first contact portion 93. Since the upper end 93A of the first contact portion 93 extends in the conveying direction F1 and the length L3 of the upper end 93A in the conveying direction F1 is longer than the length L4 of each of the upper ends 94A and 95A in the conveying direction F1, the upper end 93A of the first contact portion 93 reliably raises the middle portion of the first sheet SH1 in the width direction WF over the long range in this way. Since both the edge portions of the first sheet SH1 in the width direction WF are not supported from below by the respective upper ends 93A, 94A, and 95A of the first contact portion 93, the second contact portion 94, and the third contact portion 95 at this time, both the edge portions of the first sheet SH1 in the width direction WF hang down and come close to the stacking surface 92A. Accordingly, the first sheet SH1 is reliably curved in an inverted U-shape in the cross-section thereof perpendicular to the conveying direction F1, so that the first sheet SH1 may have good stiffness. Further, although not shown, even when the second sheet SH2 having the smallest size is thin and easily bendable, the second sheet SH2 is deformed in the same manner as the first sheet SH1 shown in FIG. 6A. Accordingly, the second sheet SH2 may have stiffness. As a result, a plurality of sheets SH, which are thin and easily bendable, may be stably discharged and stacked onto the stacking surface 92A in the sheet conveying device.

Meanwhile, when the lower end portions of the pushing members 49A and 49B come into contact with both the edge portions of the sheet SH, which is placed on the stacking surface 92A, in the width direction WF, the pushing members 49A and 49B prevent both the edge portions from being raised by pushing both the edge portions and preferably maintain a state in which the sheet SH is curved in an inverted U-shape.

Meanwhile, as shown in FIG. 6B, when the sheet SH, which is discharged onto the stacking surface 92A by the discharge section 47, is the second sheet SH2 having the smallest size, such as a postcard, and the second sheet SH2 is discharged from the discharge section 47 in the conveying direction F1, the second sheet SH2 is supported from below by the respective upper ends 93A, 94A, and 95A of the first contact portion 93, the second contact portion 94, and the third contact portion 95. In this case, one end portion and the other end portion of the second sheet SH2 in the width direction WF are raised by the upper end 94A of the second contact portion 94 and the upper end 95A of the third contact portion 95. Since the second sheet SH2 is not easily bendable, one end portion and the other end portion of the second sheet SH2 in the width direction WF do not easily hang down due to weight.

Here, the distance L2 between the upper end 94A of the second contact portion 94 and the upper end 95A of the third contact portion 95 in the width direction WF is equal to or smaller than a distance W2 between both edges, in the width direction WF, of the second sheet SH2 having the smallest size which can be conveyed by the conveying section 4. Accordingly, the upper end 94A of the second contact portion 94 and the upper end 95A of the third contact portion 95 reliably come into contact with both edges of the second sheet SH2 in the width direction WF or portions of the second sheet SH2 at an inner side of both edges in the width direction WF from below. As a result, both the edges of the second sheet SH2 may be separated upward from the stacking surface 92A. That is, the inclination of the second sheet SH2 relative to the stacking surface 92A is suppressed by the upper end 94A of the second contact portion 94 and the upper end 95A of the third contact portion 95. In particular, in the image reading apparatus 1, the upper end 94A of the second contact portion 94 and the upper end 95A of the third contact portion 95 are flat surfaces facing upwardly and have the same height H1 as the upper end 93A of the first contact portion 93. Accordingly, the second sheet SH2 may be supported by the respective upper ends 93A, 94A, and 95A so as to be parallel to the stacking surface 92A. Therefore, the inclination of the second sheet SH2 on the stacking surface 92A may be substantially prevented. For this reason, the second sheet SH2, which is discharged onto the stacking surface 92A later, does not easily interfere with a previous second sheet SH2. Further, although not shown, even when the first sheet SH1 having a large size is thick paper, such as drawing paper, and is not easily bendable, one end portion and the other end portion of the first sheet SH1 in the width direction WF do not easily hang down due to gravity, similar to the second sheet SH2 shown in FIG. 6B. Therefore, the inclination of the first sheet SH1 may be substantially prevented. As a result, a plurality of small-sized sheets SH or a plurality of sheets SH, which are thick and not easily bendable, may also be stably discharged and stacked onto the stacking surface 92A in the sheet conveying device.

A case in which the second contact portion 94 and the third contact portion 95 are not present and a second sheet SH2 is supported by only the first contact portion 93 is assumed as a comparative example, and the second sheet SH2 in this case is shown by a thin two-dot chain line in FIG. 6B. In this case, the second sheet SH2 is inclined about the upper end 93 of the first contact portion 93 as a center, so that one edge of the second sheet SH2 in the width direction WF comes into contact with the stacking surface 92A and the other edge thereof in the width direction WF is likely to be separated upward from the stacking surface 92A. For this reason, the sheet SH, which is discharged onto the stacking surface 92A later, easily interferes with a previous sheet SH that has been inclined. As a result, there is a concern that the discharge of a later sheet SH is hindered or a plurality of sheets SH are stacked on the stacking surface 92A without being aligned.

Accordingly, in the image reading apparatus 1 of the first illustrative embodiment, a plurality of sheets SH may be stably discharged and stacked onto the stacking surface 92A regardless of the kinds of sheets SH.

Further, in the image reading apparatus 1, the first contact portion 93, the second contact portion 94, and the third contact portion 95 are integrally molded so as to rise upward from the stacking surface 92A. Accordingly, work for attaching the first contact portion 93, the second contact portion 94, and the third contact portion 95 on the stacking surface 92A is not necessary in the image reading apparatus 1. Furthermore, by integral molding, it is possible to reduce variations in the positions of the first contact portion 93, the second contact portion 94, and the third contact portion 95 on the stacking surface 92A.

Second Illustrative Embodiment

Figure 7:
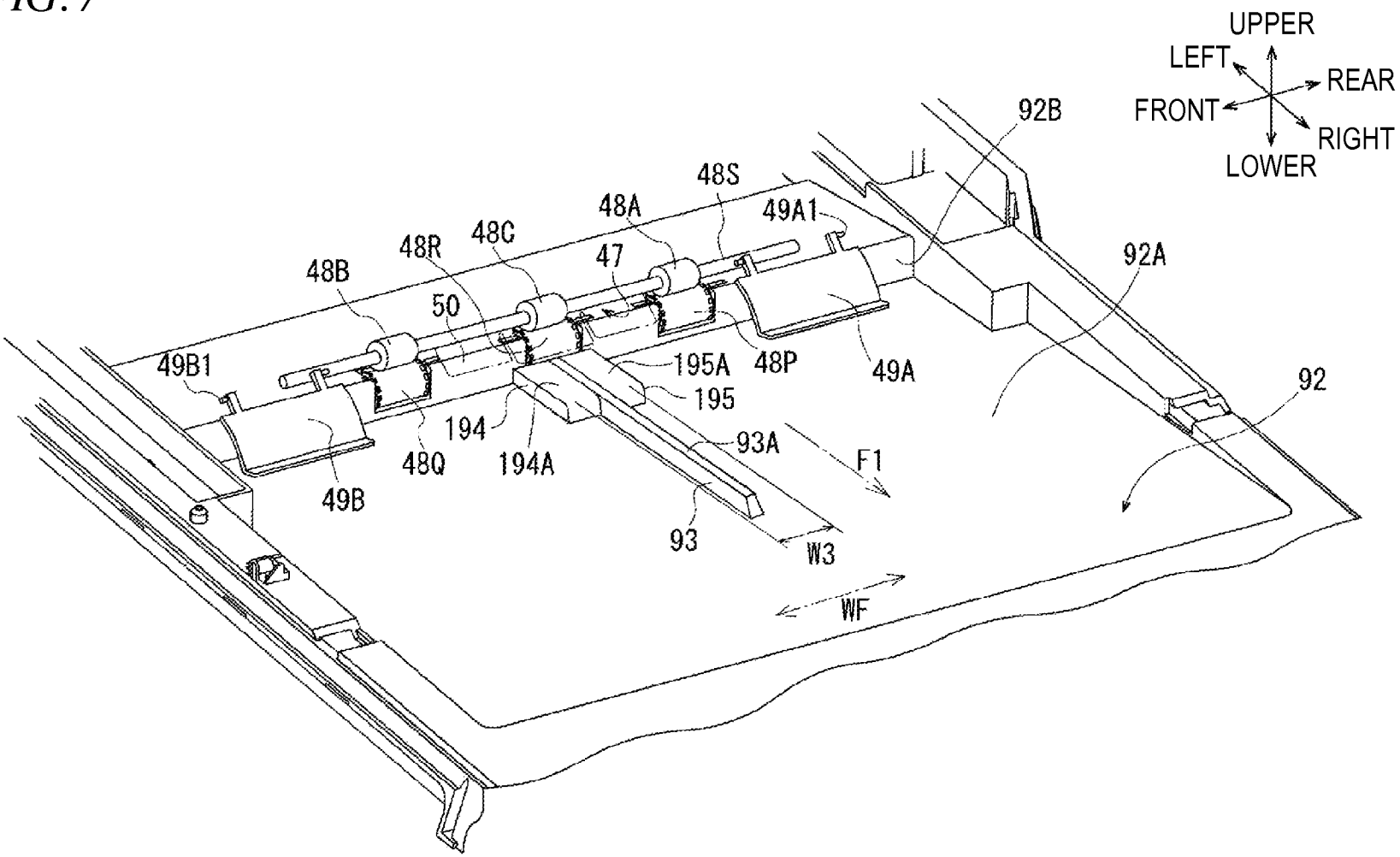

As shown in FIG. 7, in an image reading apparatus of a second illustrative embodiment, a distance between both edges, in the width direction WF, of a sheet SH having the smallest size which can be conveyed by the conveying section 4 is W3 which corresponds to a business card or the like. For this reason, in the second illustrative embodiment, a set of a discharge roller 48C and a pinch roller 48R is added between the set of the discharge roller 48A and the pinch roller 48P positioned on the rear side and the set of the discharge roller 48B and the pinch roller 48Q positioned on the front side.

Further, the second illustrative embodiment uses a modified second contact portion 194 in which the second contact portion 94 of the first illustrative embodiment extends to the rear side so as to be connected to the surface of the first contact portion 93 facing the front side and a modified third contact portion 195 in which the third contact portion 95 of the first illustrative embodiment extends to the front side so as to be connected to the surface of the first contact portion 93 facing the rear side. An upper end 194A of the second contact portion 194 and an upper end 195A of the third contact portion 195 are connected to the upper end 93A of the first contact portion 93, and form one flat surface parallel to the stacking surface 92A.

Other structure of the second illustrative embodiment is the same as that of the first illustrative embodiment. For this reason, the same components as those of the first illustrative embodiment will be denoted by the same reference numerals, and the description thereof will be omitted.

The same effects as the effects of the image reading apparatus 1 of the first illustrative embodiment can also be obtained from the image reading apparatus of the second illustrative embodiment having this structure. In particular, in the image reading apparatus, the distance W3 between both edges, in the width direction WF, of a sheet SH having the smallest size which can be conveyed by the set of the discharge roller 48C and the pinch roller 48R is close to the length of the upper end 93A of the first contact portion 93 in the front and rear direction. Nevertheless, portions of the upper end 194A of the second contact portion 194 and the upper end 195A of the third contact portion 195, which are adjacent to portions thereof connected to the upper end 93A of the first contact portion 93A, come into contact with the sheet SH having the smallest size from below. Accordingly, the inclination of the sheet SH can be suppressed.

Third Illustrative Embodiment

Figure 8:
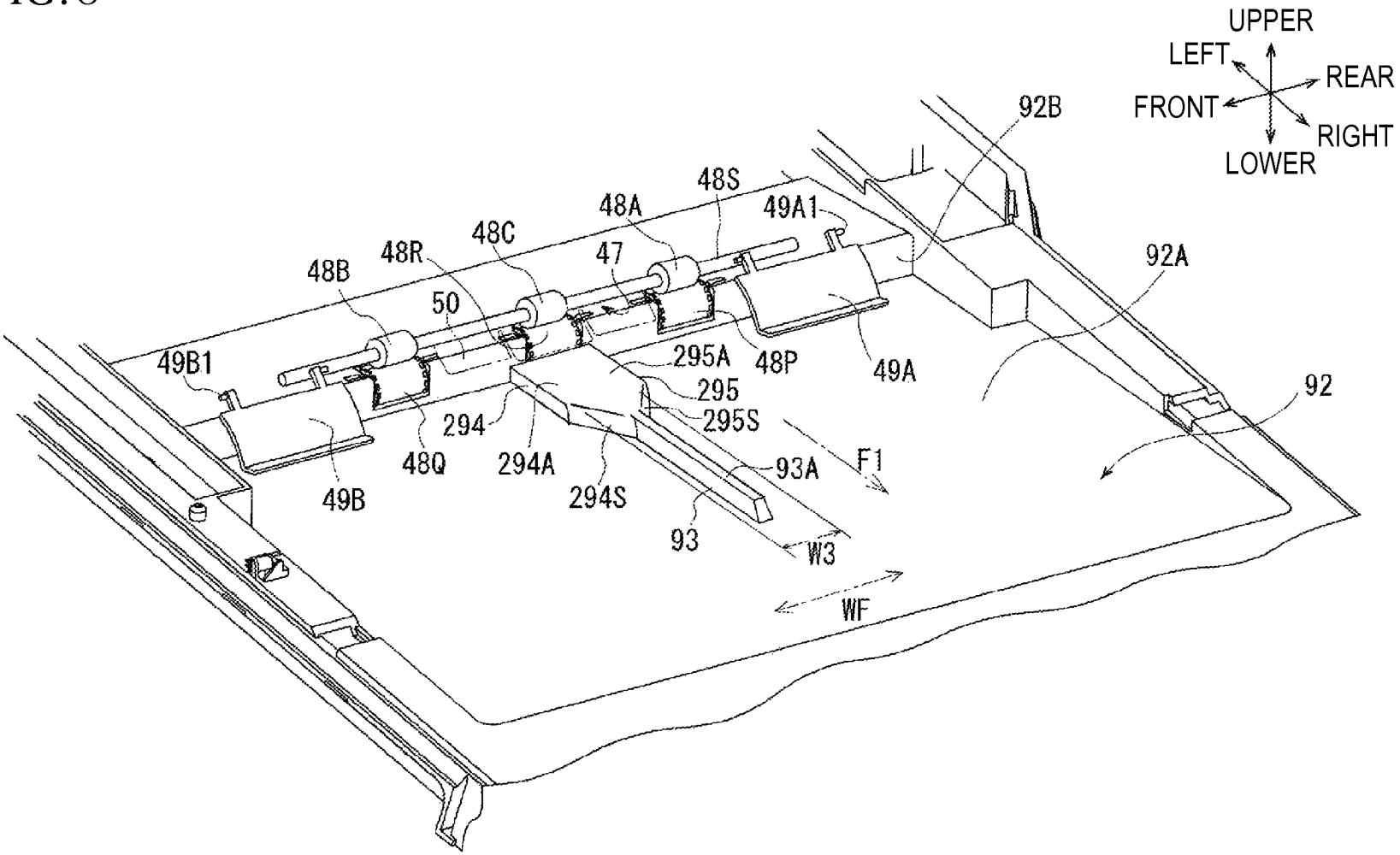

As shown in FIG. 8, an image reading apparatus of a third illustrative embodiment uses a second contact portion 294 that includes an inclined surface 294S formed through removal of the front right corner of the second contact portion 194 of the second illustrative embodiment and a third contact portion 295 that includes an inclined surface 295S formed through removal of the rear right corner of the third contact portion 195 of the second illustrative embodiment. Other structure of the third illustrative embodiment is the same as that of the second illustrative embodiment. For this reason, the same components as those of the second illustrative embodiment will be denoted by the same reference numerals, and the description thereof will be omitted.

In the third illustrative embodiment, the inclined surface 294S of the second contact portion 294 is inclined so as to come close to the side surface of the first contact portion 93 facing the front side in the conveying direction F1. The inclined surface 295S of the third contact portion 295 is inclined so as to come close to the side surface of the first contact portion 93 facing the rear side in the conveying direction F1.

The same effects as the effects of the image reading apparatuses 1 of the first and second illustrative embodiments may also be obtained from the image reading apparatus of the third illustrative embodiment having this structure. Further, in the image reading apparatus, due to the second contact portion 294 and the third contact portion 295 that include the inclined surfaces 294S and 295S, the action of the first contact portion 93 making a sheet SH, which is thin and easily bendable, to have good stiffness is not easily hindered.

Fourth Illustrative Embodiment

Figure 9:
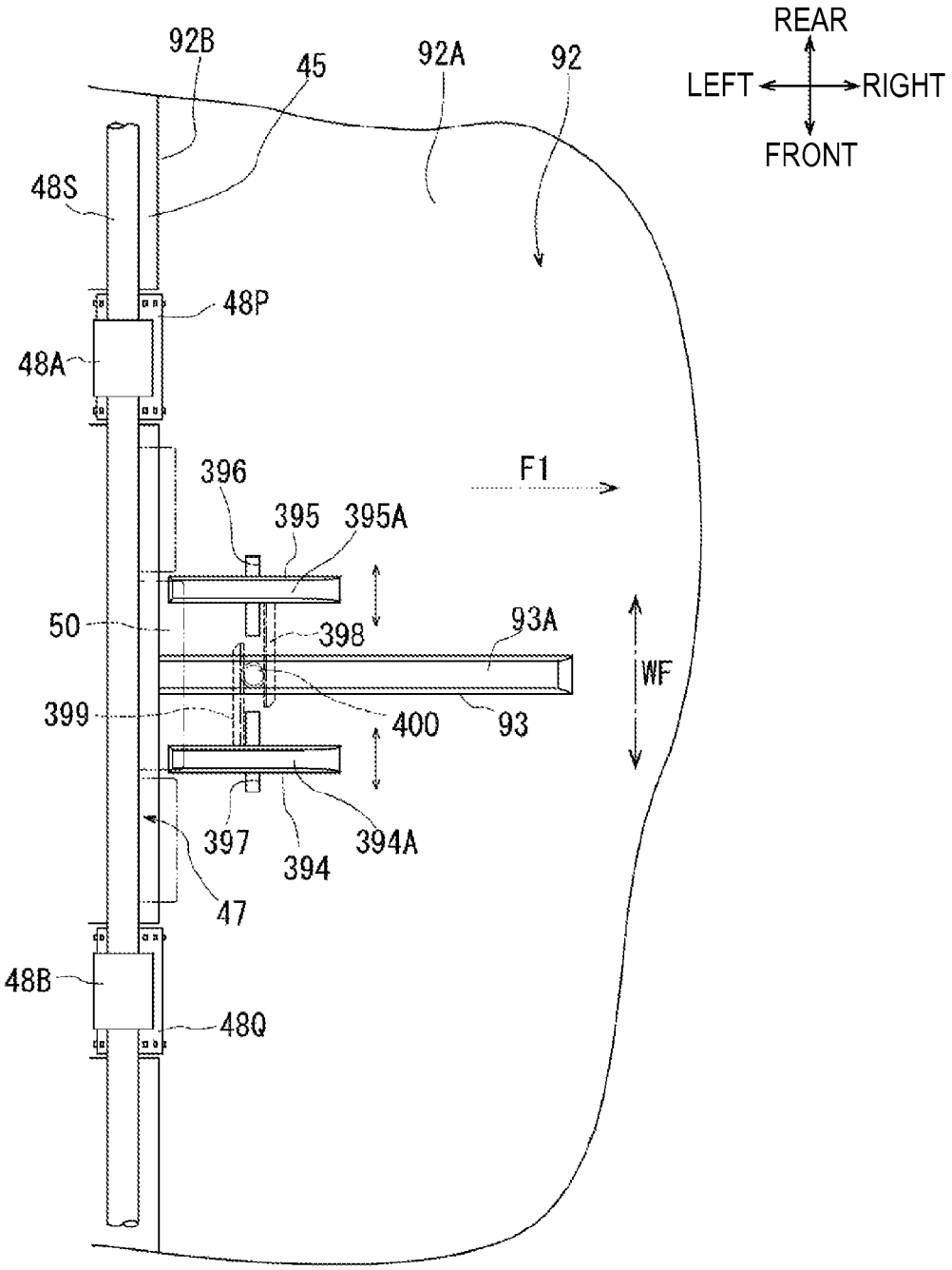

As shown in FIG. 9, an image reading apparatus of a fourth illustrative embodiment uses second and third contact portions 394 and 395 instead of the second and third contact portions 94 and 95 of the first illustrative embodiment. Other structure of the fourth illustrative embodiment is the same as that of the first illustrative embodiment. For this reason, the same components as those of the first illustrative embodiment will be denoted by the same reference numerals, and the description thereof will be omitted.

In the fourth illustrative embodiment, the second and third contact portions 394 and 395 are supported by the discharge tray 92 so as to be capable of coming close to each other and being separated from each other in the width direction WF. The second and third contact portions 394 and 395 can move along slots 396 and 397, which are formed to the stacking surface 92A, in the width direction WF. Racks 398 and 399 are provided at the second and third contact portions 394 and 395 below the stacking surface 92A. A pinion 400 meshes with the racks 398 and 399. Accordingly, even though the second and third contact portions 394 and 395 come close to each other and are separated from each other in the width direction WF, the first contact portion 93 is always positioned between the second and third contact portions 394 and 395.

The same effects as the effects of the image reading apparatuses 1 of the first to third illustrative embodiments may also be obtained from the image reading apparatus of the fourth illustrative embodiment having this structure. Further, in the image reading apparatus, a distance between the upper end 394A of the second contact portion 394 and the upper end 395A of the third contact portion 395 in the width direction WF can be changed according to the size of a sheet SH that is conveyed to the conveying section 4. Accordingly, in the image reading apparatus, the inclination of a sheet SH on the stacking surface 92A may be preferably suppressed regardless of the size of a small-sized sheet SH or a sheet SH that is thick and not easily bendable.

Meanwhile, a distance between the second and third contact portions 394 and 395 may be adjusted in response to the operation of the pair of guides 60A and 60B of the feed tray 91.

While the disclosure has been described in detail with reference to the first to fourth illustrative embodiments, these are merely examples, and various changes, arrangements and modifications may be applied without departing from the spirit and scope of the disclosure.

For example, the first contact portion, the second contact portion, and the third contact portion may protrude from the stacking surface, and may extend in the conveying direction like a cantilever while being separated upward from the stacking surface. Further, the first contact portion, the second contact portion, and the third contact portion may have various shapes, such as a shape of a pyramid, a shape of a column, a shape of a block, and a shape of a rib.

The upper end of the first contact portion, the upper end of the second contact portion, and the upper end of the third contact portion are not limited to the flat surfaces, and may have a shape of a ridge. Portions of the first contact portion, which face the second and third contact portions in the width direction WF, may be omitted.

The above configurations can be used in various sheet conveying devices, for example, an image reading apparatus, an image forming apparatus, a multifunctional machine, or the like.

The present invention provides illustrative, non-limiting aspects as follows:

(1) A sheet conveying device sheet conveying device including: a conveying section configured to convey a sheet in a predetermined conveying direction; a discharge section configured to discharge the sheet onto a stacking surface and configured to support the sheet, which is discharged by the discharge section, from below; a first contact portion provided on the stacking surface at a middle portion of the stacking surface in a width direction orthogonal to the conveying direction; a second contact portion provided on the stacking surface at one side with respect to the first contact portion in the width direction; and a third contact portion provided on the stacking surface at an other side with respect to the first contact portion in the width direction.

In the sheet conveying device according to (1), when a sheet, which is thin and easily bendable, is discharged onto the stacking surface, the middle portion of the sheet in the width direction is raised by the upper end of the first contact portion. Accordingly, it is possible to make the sheet have stiffness by curving the sheet in an inverted U-shape in the cross-section thereof perpendicular to the conveying direction. As a result, in the sheet conveying device, a plurality of sheets, which are thin and easily bendable, may be stably discharged and stacked onto the stacking surface.

(2) The sheet conveying device according to (1), wherein the stacking surface is positioned on a downstream side of the discharge section in the conveying direction and extends in the conveying direction and the width direction.

(3) The sheet conveying device according to (2), wherein the first contact portion extends further to the downstream side in the conveying direction than the second and third contact portions.

According to (3), the middle portion of a sheet, which is thin and easily bendable, in the width direction is raised over a long range by a portion of the first contact portion that extends further to the downstream side in the conveying direction than the second and third contact portions. Accordingly, it is possible to make the sheet easily have stiffness by reliably curving the sheet in an inverted U-shape in the cross-section thereof perpendicular to the conveying direction. As a result, in the sheet conveying device, a plurality of sheets, which are thin and easily bendable, may be more stably discharged and stacked onto the stacking surface.

(4) The sheet conveying device according to (1), wherein the first contact portion has an upper end positioned above the stacking surface, extends in the conveying direction, and is configured to come into contact with the sheet, which is discharged by the discharge section, from below, wherein the second contact portion has an upper end positioned above the stacking surface, and is configured to come into contact with the sheet, which is discharged by the discharge section, from below, and wherein the third contact portion has an upper end positioned above the stacking surface, and is configured to come into contact with the sheet, which is discharged by the discharge section, from below.

(5) The sheet conveying device according to (4), wherein a distance between the upper end of the second contact portion and the upper end of the third contact portion in the width direction is equal to or smaller than a distance between both edges, in the width direction, of a sheet having a smallest size which can be conveyed by the conveying section.

According to (5), when a small-sized sheet or a sheet which is thick and not easily bendable is discharged onto the stacking surface, one end portion and the other end portion of the sheet in the width direction are raised by the upper end of the second contact portion and the upper end of the third contact portion. Here, a distance between the upper end of the second contact portion and the upper end of the third contact portion in the width direction is equal to or smaller than a distance between both edges, in the width direction, of a sheet having the smallest size which can be conveyed by the conveying section. Accordingly, the upper end of the second contact portion and the upper end of the third contact portion reliably come into contact with both edges of the sheet in the width direction or portions of the sheet at an inner side of both the edges in the width direction from below. As a result, both edges of the sheet may be separated upward from the stacking surface. That is, the inclination of the sheet relative to the stacking surface is suppressed by the upper end of the second contact portion and the upper end of the third contact portion. For this reason, the sheet, which is discharged onto the stacking surface later, does not easily interfere with a previous sheet. As a result, in the sheet conveying device, a plurality of small-sized sheets or a plurality of sheets which are thick and not easily bendable may also be stably discharged and stacked onto the stacking surface.

(6) The sheet conveying device according to (4), wherein the upper end of the second contact portion and the upper end of the third contact portion are configured by flat surfaces facing upward, which are configured to come into contact with the sheet, which is discharged onto the stacking surface, from below.

According to (6), by the flat surfaces of the second and third contact portions, the inclination of a small-sized sheet or a sheet which is thick and not easily bendable is preferably suppressed and the sheet may be stably supported so as to be substantially parallel to the flat surfaces of the second and third contact portions.

(7) The sheet conveying device according to (4), wherein at least a part of the upper end of the second contact portion and at least a part of the upper end of the third contact portion are connected to the upper end of the first contact portion.

According to (7), in the image reading apparatus, even though the distance between both edges, in the width direction, of a sheet having the smallest size which can be conveyed by the conveying section is close to the length of the first contact portion in the width direction, portions of the upper end of the second contact portion and the upper end of the third contact portion, which are adjacent to portions thereof connected to the upper end of the first contact portion, come into contact with the sheet having the smallest size from below. Accordingly, the inclination of the sheet may be suppressed.

(8) The sheet conveying device according to (4), wherein the upper end of the second contact portion and the upper end of the third contact portion has the same height as the upper end of the first contact portion.

According to (8), the upper end of the first contact portion, the upper end of the second contact portion, and the upper end of the third contact portion, which have the same height, come into contact with a small-sized sheet or a sheet which is thick and not easily bendable from below. Accordingly, in the sheet conveying device, the sheet may be supported by these upper ends so as to be parallel to the stacking surface. As a result, a plurality of small-sized sheets or a plurality of sheets which are thick and not easily bendable may be more stably discharged and stacked onto the stacking surface.

(9) The sheet conveying device according to (8), further including: a pushing member which extends toward the stacking surface from above, wherein a distance between a lower end of the pushing member and the stacking surface is smaller than a distance between each of the upper ends of the first, second and third contact portions and the stacking surface.

(10) The sheet conveying device according to (1), wherein the first contact portion, the second contact portion, and the third contact portion are integrally molded with the stacking surface so as to rise upward from the stacking surface.

According to (10), work for attaching the first contact portion, the second contact portion, and the third contact portion on the stacking surface is not necessary. Further, by integral molding, it is possible to reduce deviation in the disposition of the first contact portion, the second contact portion, and the third contact portion on the stacking surface.

(11) The sheet conveying device according to (1), wherein the second and third contact portions are configured to come close to each other and be separated from each other in the width direction.

According to (11), a distance between the upper end of the second contact portion and the upper end of the third contact portion in the width direction can be changed according to the size of the sheet that is conveyed to the conveying section. Accordingly, in the sheet conveying device, the inclination of the sheet on the stacking surface may be preferably suppressed regardless of the size of a small-sized sheet or a sheet that is thick and not easily bendable.

(12) The sheet conveying device according to (1), further including: a reading section that is provided on an upstream side of the discharge section in the conveying direction and configured to read an image of the sheet conveyed by the conveying section.

According to (12), a plurality of sheets of which the images have been read by the reading section may be stably discharged and stacked onto the stacking surface.

(13) The sheet conveying device according to (1), further including: a guide piece positioned above the stacking surface in the middle of the discharge section in the width direction.

(14) The sheet conveying device according to (13), wherein a lower end portion of the guide piece is inclined downward toward the first contact portion, the second contact portion, and the third contact portion.

(15) A sheet conveying device including: a conveying section configured to convey a sheet in a predetermined conveying direction; a discharge section configured to constitute a part of the conveying section and discharge the sheet onto a stacking surface positioned on a downstream side of the discharge section in the conveying direction, the stacking surface extending in the conveying direction and a width direction orthogonal to the conveying direction and configured to support a lower surface of the sheet discharged by the discharge section; a first contact portion provided above the stacking surface at the middle in the width direction, extending in the conveying direction, and configured to come into contact with the lower surface of the sheet discharged by the discharge section; a second contact portion provided above the stacking surface at one side with respect to the first contact portion in the width direction, and configured to come into contact with the lower surface of the sheet discharged by the discharge section; and a third contact portion provided above the stacking surface at an other side with respect to the first contact portion in the width direction, and configured to come into contact with the lower surface of the sheet discharged by the discharge section, wherein a distance between an upper end of the second contact portion and an upper end of the third contact portion in the width direction is equal to or smaller than a distance between both edges, in the width direction, of a sheet having a smallest size which can be conveyed by the conveying section.

What is claimed is:

1. A sheet conveying device comprising:

a conveyer configured to convey a sheet in a conveying direction;

a discharge section configured to discharge the sheet onto a stacking surface, the stacking surface configured to support the sheet discharged by the discharge section, from below, the discharge section including a discharge roller and a pinch roller;

a first contact portion extending a height from a first portion of the stacking surface in a vertical direction orthogonal to the conveying direction and a width direction, the first portion corresponding to a middle portion of the stacking surface in the width direction;

a second contact portion extending a height from a second portion of the stacking surface, the second contact portion being at one side with respect to the first contact portion in the width direction;

a third contact portion extending a height from a third portion of the stacking surface, the third contact portion being at an other side with respect to the first contact portion in the width direction;

a wall extending at least partially in the vertical direction from an edge of the stacking surface closest to the discharge roller; and a pushing member which extends toward the stacking surface from above, wherein, when viewed in the conveying direction, the pushing member does not overlap any discharge roller of the discharge section, and is disposed farther from a center of the discharge section in the width direction than any discharge roller of the discharge section, wherein a distance between a lower end of the pushing member and the stacking surface is smaller than each of the heights of the first, second and third contact portions and the stacking surface, wherein each of the first contact portion, the second contact portion and the third contact portion extends from the wall in the conveying direction, wherein the pinch roller is disposed below the discharge roller in the vertical direction, and wherein at least a portion of the pinch roller is located downstream of the wall in the conveying direction, wherein a distance in the vertical direction between the stacking surface and a first part of the pinch roller farthest from the stacking surface, in the vertical direction, is greater than each of the heights of the first contact portion, the second contact portion and the third contact portion, and wherein a distance in the vertical direction between the stacking surface and a second part of the pinch roller closest to the stacking surface, in the vertical direction, is less than each of the heights of the first contact portion, the second contact portion and the third contact portion.

2. The sheet conveying device according to claim 1, wherein the stacking surface is positioned on a downstream side of the discharge section in the conveying direction and extends in the conveying direction and the width direction.

3. The sheet conveying device according to claim 2, wherein the first contact portion extends further to the downstream side in the conveying direction than the second and third contact portions.

4. The sheet conveying device according to claim 1, wherein the first contact portion has an upper end positioned above the stacking surface, and is configured to come into contact with the sheet, which is discharged by the discharge section, from below, wherein the second contact portion has an upper end positioned above the stacking surface, and is configured to come into contact with the sheet, which is discharged by the discharge section, from below, and wherein the third contact portion has an upper end positioned above the stacking surface, and is configured to come into contact with the sheet, which is discharged by the discharge section, from below.

5. The sheet conveying device according to claim 4, wherein a distance between the upper end of the second contact portion and the upper end of the third contact portion in the width direction is equal to or smaller than a distance between both edges, in the width direction, of a sheet having a smallest size which can be conveyed by the conveyer.

6. The sheet conveying device according to claim 4, wherein the upper end of the second contact portion and the upper end of the third contact portion are configured by flat surfaces facing upward, which are configured to come into contact with the sheet, which is discharged onto the stacking surface, from below.

7. The sheet conveying device according to claim 4, wherein at least a part of the upper end of the second contact portion and at least a part of the upper end of the third contact portion are connected to the upper end of the first contact portion, thereby forming a surface wider than the upper end of the first contact portion in the width direction.

8. The sheet conveying device according to claim 4, wherein the upper end of the second contact portion and the upper end of the third contact portion has the same height as the upper end of the first contact portion.

9. The sheet conveying device according to claim 1, wherein the first contact portion, the second contact portion, and the third contact portion are integrally molded with the stacking surface so as to rise upward from the stacking surface.

10. The sheet conveying device according to claim 1, wherein the second and third contact portions are configured to move close to each other and be separated from each other in the width direction.

11. The sheet conveying device according to claim 1, further comprising:

a reading section that is provided on an upstream side of the discharge section in the conveying direction and configured to read an image of the sheet conveyed by the conveyer.

12. The sheet conveying device according to claim 1, further comprising:

a guide piece positioned above the stacking surface in the middle of the discharge section in the width direction.

13. The sheet conveying device according to claim 12, wherein a lower end portion of the guide piece is inclined downward toward the first contact portion, the second contact portion, and the third contact portion.

14. The sheet conveying device according to claim 1, wherein the discharge section includes a plurality of discharge rollers, and wherein a distance between an upper end of the second contact portion and an upper end of the third contact portion in the width direction is smaller than a distance between two of the plurality of discharge rollers which are positioned most centrally in the width direction among the plurality of discharge rollers.

15. The sheet conveying device according to claim 1, wherein the first contact portion, the second contact portion and the third contact portion are provided on a central portion of the stacking surface in the width direction, and wherein a respective pressing member is provided at each side of the central portion in the width direction.

16. The sheet conveying device according to claim 1, wherein the second and third contact portions are configured to move close to each other and be separated from each other in the width direction.

17. The sheet conveying device according to claim 1, wherein each of the first, second and third contact portions are integral with the wall.

* * * * *